US005728035A

United States Patent [19]

Sands

[11] Patent Number: 5,728,035

[45] Date of Patent: Mar. 17, 1998

[54] ANCHOR PLATE FOR ABDOMINAL EXERCISE DEVICE

[75] Inventor: Leonard I. Sands, Tarzana, Calif.

[73] Assignee: Guthy-Renker Corp., Santa Monica, Calif.

[21] Appl. No.: 642,467

[22] Filed: May 3, 1996

[51] Int. Cl.[6] ..... A63B 23/02

[52] U.S. Cl. ..... 482/140; 482/132; 482/142

[58] Field of Search ..... 482/130, 132, 482/140, 142, 144, 146, 148, 908; D21/191, 193; 472/101, 135; 297/261.1, 261.2, 261.4, 270.2, 272.1, 272.4; 248/133, 193, 185.1, 202.1; 182/111

[56] References Cited

U.S. PATENT DOCUMENTS

| | | | |
|---|---|---|---|
| 180,933 | 8/1876 | Rupp | 297/261.4 |
| D. 286,802 | 11/1986 | Ahlberg . | |
| D. 298,959 | 12/1988 | DeGalez . | |
| D. 348,491 | 7/1994 | Diep . | |
| D. 380,517 | 7/1997 | Ho | D21/191 |
| 1,244,371 | 10/1917 | Reynolds . | |
| 2,429,939 | 10/1947 | Masterson et al. . | |
| 2,533,273 | 12/1950 | MacGregor . | |
| 2,563,407 | 8/1951 | Haims . | |
| 2,722,967 | 11/1955 | Reinholz . | |
| 3,077,347 | 2/1963 | Nova . | |
| 3,540,724 | 11/1970 | Hunter . | |
| 3,591,173 | 7/1971 | Cossman . | |
| 3,858,873 | 1/1975 | Jones . | |
| 3,866,605 | 2/1975 | Stakeman . | |
| 3,998,454 | 12/1976 | Jones . | |
| 4,141,588 | 2/1979 | Anderson . | |
| 4,182,511 | 1/1980 | Camp, Jr. . | |
| 4,228,999 | 10/1980 | Armstrong . | |
| 4,241,949 | 12/1980 | Parker . | |
| 4,258,952 | 3/1981 | Dutra . | |
| 4,367,870 | 1/1983 | Birch . | |
| 4,372,553 | 2/1983 | Hatfield . | |
| 4,405,128 | 9/1983 | McLaughlin et al. . | |
| 4,457,510 | 7/1984 | Pertschuk . | |
| 4,508,335 | 4/1985 | Kelly et al. . | |
| 4,527,833 | 7/1985 | Parker . | |
| 4,541,628 | 9/1985 | Parviainen . | |
| 4,582,319 | 4/1986 | Luna | 272/136 |
| 4,591,148 | 5/1986 | Slater | 272/93 |
| 4,595,234 | 6/1986 | Kjersem . | |
| 4,659,075 | 4/1987 | Wilkinson | 482/115 |

(List continued on next page.)

FOREIGN PATENT DOCUMENTS

| | | |
|---|---|---|
| 3632124A1 | 9/1986 | Germany . |
| WO94/00201 | 1/1994 | WIPO . |

*Primary Examiner*—Jeanne M. Clark
*Attorney, Agent, or Firm*—Cislo & Thomas

[57] ABSTRACT

Anchor plates for a framework abdominal exercise device provide greater stability, a stable axis of rotation, and a better location for the axis of rotation. A base pad is flanked by two brace supports that have a wide lower portion for distributing forces and a narrower upper portion for engaging the abdominal exercise device. The brace supports are separated by a greater width at their lower portion than at their upper portion. Intermediating the disparity between these separating widths is an intermediate portion that slants inwardly and acts as a shock-absorbing spring to provide better performance by the anchor plate. The base pad of the anchor plate may have an undersurface of a non-skid material to provide greater friction with an underlying floor, thereby preventing slipping and sliding. In alternative embodiments of the present invention, side reinforcing ridges may extend forwardly from the lower forward portions of the brace supports to provide greater support to the brace supports. A rear extension may also provide greater stability. Pivot holes present at the top of the brace supports provide means by which the associated abdominal exercise device may be bolted or otherwise pivotally attached to the anchor plate. The pivot hole is located off-center with respect to the base pad, generally rearwardly rearward of the center of base pad, to provide greater stability and performance.

5 Claims, 4 Drawing Sheets

U.S. PATENT DOCUMENTS 4,729,562 3/1988 Pipasik .
4,752,067 6/1988 Colonello .
4,807,873 2/1989 Naquin ..... 272/93
4,863,158 9/1989 Tassone .
4,902,003 2/1990 Buoni .
4,919,481 4/1990 Garabedian ..... 297/258
4,976,423 12/1990 Routti ..... 272/72
5,056,779 10/1991 Webb ..... 272/134
5,074,549 12/1991 Harvey ..... 272/93
5,098,089 3/1992 Harrington et al. ..... 482/140
5,100,130 3/1992 Shoebrooks ..... 482/121
5,120,052 6/1992 Evans ..... 482/145
5,122,107 6/1992 Gardner .
5,125,560 6/1992 Paris .
5,125,650 6/1992 Paris .
5,125,883 6/1992 Shoebrooks .
5,141,482 8/1992 Hern .
5,160,304 11/1992 Van Der Hoeven .
5,160,306 11/1992 Lui .
5,163,889 11/1992 Kaaua .
5,169,372 12/1992 Tecco .
5,176,603 1/1993 Hundley et al. .
5,186,702 2/1993 Amanze .
5,190,513 3/1993 Habing et al. .
5,195,938 3/1993 Robertson .
5,207,628 5/1993 Graham .
5,213,558 5/1993 Miller et al. .
5,224,914 7/1993 Friedman .
5,232,425 8/1993 Miller et al. .
5,248,287 9/1993 Nicoletti .
5,267,931 12/1993 Faetini .
5,279,533 1/1994 Yin et al. .
5,290,209 3/1994 Wilkinson .
5,290,215 3/1994 Lin .
5,295,949 3/1994 Hathaway .
5,300,004 4/1994 Muehlenbein .
5,324,247 6/1994 Lepley .
5,328,434 7/1994 Carroll .
5,328,435 7/1994 Ricks .
5,342,274 8/1994 Hunker .
5,368,537 11/1994 Felice .
5,372,558 12/1994 Perry et al. .
5,372,566 12/1994 Olschansky et al. .
5,403,253 4/1995 Gaylord .
5,403,258 4/1995 Hill .
5,407,404 4/1995 Killian et al. .
5,417,636 5/1995 Havens .
5,433,689 7/1995 Frins .
5,441,473 8/1995 Safani et al. .
5,458,549 10/1995 Obery .
5,466,205 11/1995 McLane et al. .
5,474,513 12/1995 Carlesimo et al. .
5,492,520 2/1996 Brown .
5,496,247 3/1996 Anderson .
5,545,114 8/1996 Groich ..... 482/140
5,577,987 11/1996 Brown .
5,591,111 1/1997 Wang et al. ..... 482/140

ANCHOR PLATE FOR ABDOMINAL EXERCISE DEVICE

BACKGROUND OF THE INVENTION

1. Field of the Invention

The present invention relates to anchor plates or foot brackets for abdominal exercise devices and the like, and more particularly to an anchor plate for an abdominal exercise device having an upright bar that is forward of the head and arm rests.

2. Description of the Related Art

Over the past several years, there has been a greater interest in physical fitness in order to provide for one's better health as well as a more pleasing physical appearance. To this end, many people concentrate on developing the abdominal muscles of the belly in order to provide greater support for their back, or spine, as well as to present a more attractive physical appearance when wearing a bathing suit or exposing one's midriff.

Recently, many abdominal exerciser devices have become popular that allow a person to develop their abdominal muscles by laying on the floor and rocking using a framework to support their head, neck and shoulders. The shoulder support is often achieved by arm rests or the like that support the upper arm during the abdominal rocking motion achieved by the framework device.

Of these devices, one in particular is of recent note. U.S. Pat. No. 5,492,520 issued to Brown on Feb. 20, 1996 discloses an abdominal exerciser device along the lines set forth immediately above. The Brown abdominal exerciser device, as well as many other similar devices, do not allow the user to rotate about a precise pivot point nor do they provide a stable means of engaging whatever support surface (usually, the floor) the abdominal exerciser device engages while exercising.

Without a precise pivot point about which to rotate, a framework abdominal exerciser device has a tendency to engage in a lateral back and forth motion that includes a lateral displacement of possibly several inches. This lateral movement in addition to the rotational rocking motion that is achieved through such abdominal exerciser devices. Without a precise pivot point, certain muscle groups of the abdomen cannot be precisely and continuously exercised as the axis of rotation travels forward and backward with the framework device. Additionally, with framework abdominal exerciser devices that rest upon the floor, the axis of rotation lies along the floor and is below the spine of the user. Certain torques and forces arise from the location of the rotation axis and the farther away it is from the user, the greater these forces and torques are. Such increased forces and torques may act detrimentally upon the user, possibly causing injury.

It can be seen therefore that certain and distinct advantages and benefits can be achieved by providing a precise pivot point or axis about which a framework abdominal exerciser device can rotate. Provision of such a precise rotation point is enhanced by moving the axis of rotation as close to or even within the abdominally exercising person. It is also a distinct and significant advantage in an anchor plate to provide a large surface area having a non-skid surface so that no sliding or slipping occurs while the person uses the abdominal exerciser device.

SUMMARY OF THE INVENTION

The present invention resides in an anchor plate that provides several advantages to framework abdominal exerciser devices or machines that would otherwise rock along the floor. A base pad provides a sturdy foundation and a large non-skid surface when coated beneath with a non-skid material. Two brace supports (which may be triangular in shape) rise above the base pad and pivotally connect to the abdominal exercise device. One brace support may be oppositely opposed the other, the two on either side of the base pad.

The brace supports are located so that the pivot hole used to bolt the abdominal exercise device to the brace supports is off-center and towards the rear of the base pad. The placing of the pivot point off-center serves to enhance the stability provided by the anchor plate to the abdominal exercise device. As the user lifts up with the abdominal exercise device, more support is given by the anchor plate to the abdominal exercise device than if the pivot point were moved more forward with respect to the base pad.

The upper ends of the brace supports are adjacent the exercise device and generally engage the abdominal exercise device through a bolt or the like. The space between the brace supports where they engage the base pad may be slightly wider that the space between the brace supports near the abdominal exercise device. The brace supports are generally perpendicular to the base pad. The differing widths between the upper and lower portions of the brace supports are mediated by an angled panel that may also act as a shock-absorbing spring.

Reinforcing ridges may project forwardly from the forward end of the brace supports and above the base pad by several millimeters. The reinforcing ridges may travel forward to the front extension, or front portion, of the anchor plate to enhance its stability. The stability of the anchor plate is also enhanced by front and rear extensions that demand greater forces or torques from the abdominal exercise device in order for the anchor plate to become disengaged with the floor below.

By using the anchor plate of the present invention in conjunction with an abdominal exercise device, a person seeking exercise of their abdominal muscles are able to precisely locate the axis of rotation due to the precise pivot point provided by the anchor plate. By directing the axis of rotation towards the abdominal muscle groups needing development, more exercise is provided to such muscles.

Additionally, as the brace supports of the anchor plate lift the abdominal exercise device up above the floor, the axis of rotation is moved closer to the exercising abdominal muscles. Coupled with the precise pivot point, this enables persons to more precisely locate the axis of rotation towards those areas requiring greater muscular activity, thereby focusing their workout upon certain abdominal or oblique muscles. By such focusing of muscular activity, a person's abdominal workout is greatly enhanced.

OBJECTS OF THE INVENTION

It is an object of the present invention to provide an anchor plate that provides enhanced abdominal exercise when used in conjunction with a framework abdominal exercise device.

It is an additional object of the present invention to provide an anchor plate for a framework abdominal exercise device that creates a precise pivot point or axis of rotation.

It is yet another object of the present invention to provide an anchor plate that is stable.

It is yet another object of the present invention to provide an anchor plate having shock-absorbing brace supports.

These and other objects and advantages of the present invention will be apparent from a review of the following specification and accompanying drawings.

DESCRIPTION OF THE PREFERRED EMBODIMENT(S)

The present invention resides in an anchor plate that provides stability and lift for an abdominal exercise device. As shown in the Figures, the anchor plate serves to provide a precise pivot point or axis about which the pivotally-connected abdominal exercise device may rotate.

Figure 1:
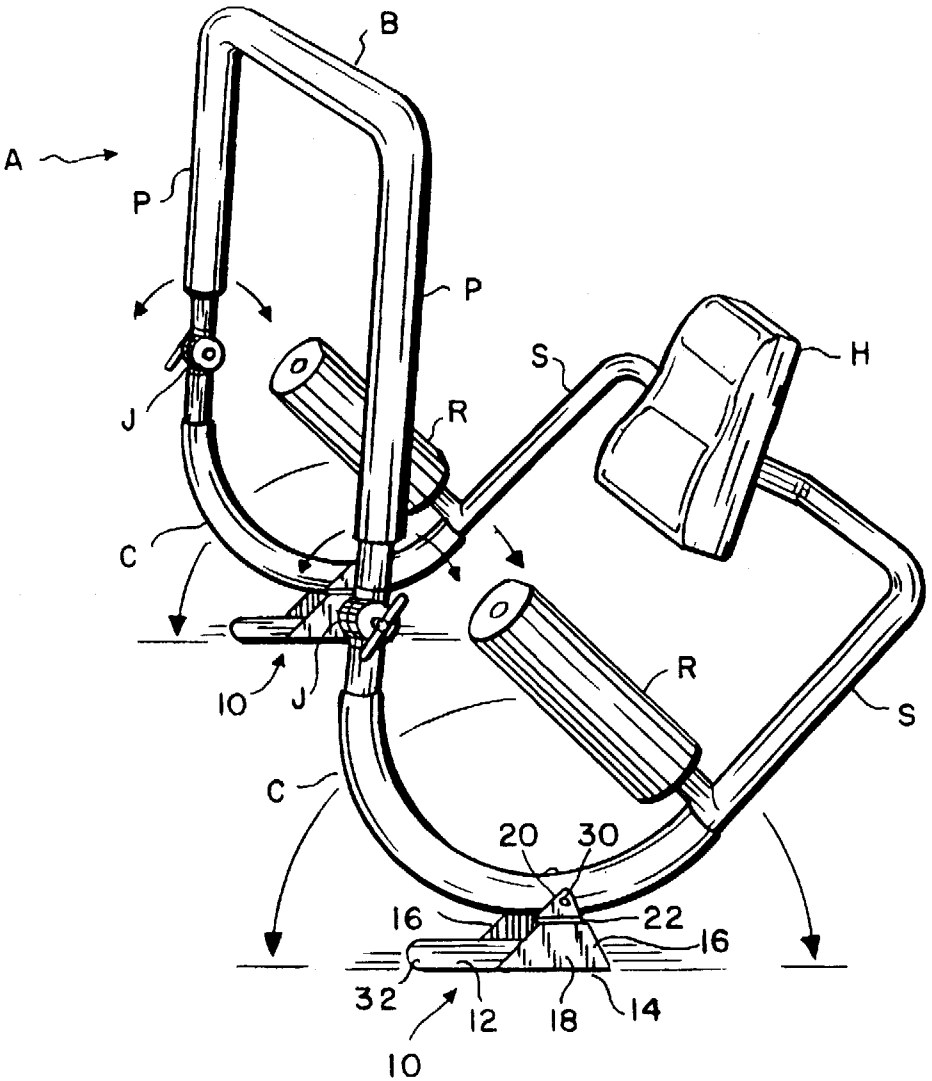
FIG. 1 is a upper perspective view of the anchor plates of the present invention attached to a framework abdominal exercise device.
Figure 2:
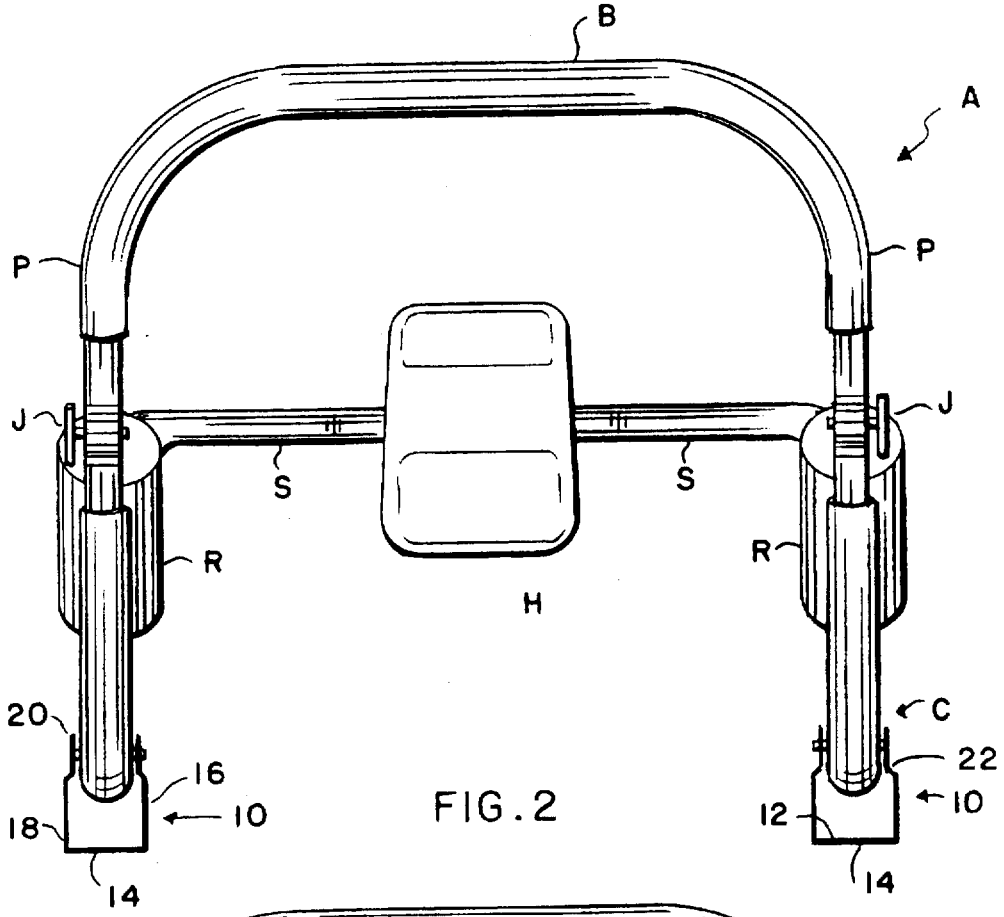
FIG. 2 is a front perspective view of the anchor plates with abdominal exercise device as shown in FIG. 1.
Figure 3:
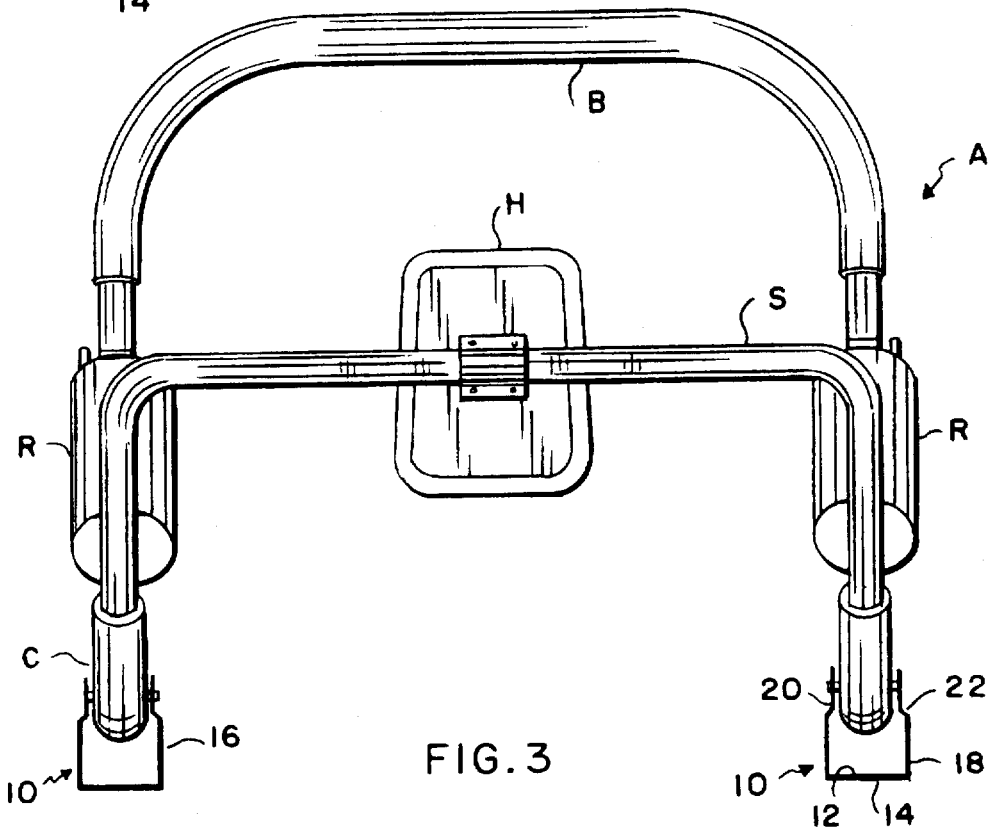
FIG. 3 is a rear view of the anchor plates and abdominal exercise device shown in FIG. 1.
Figure 4:
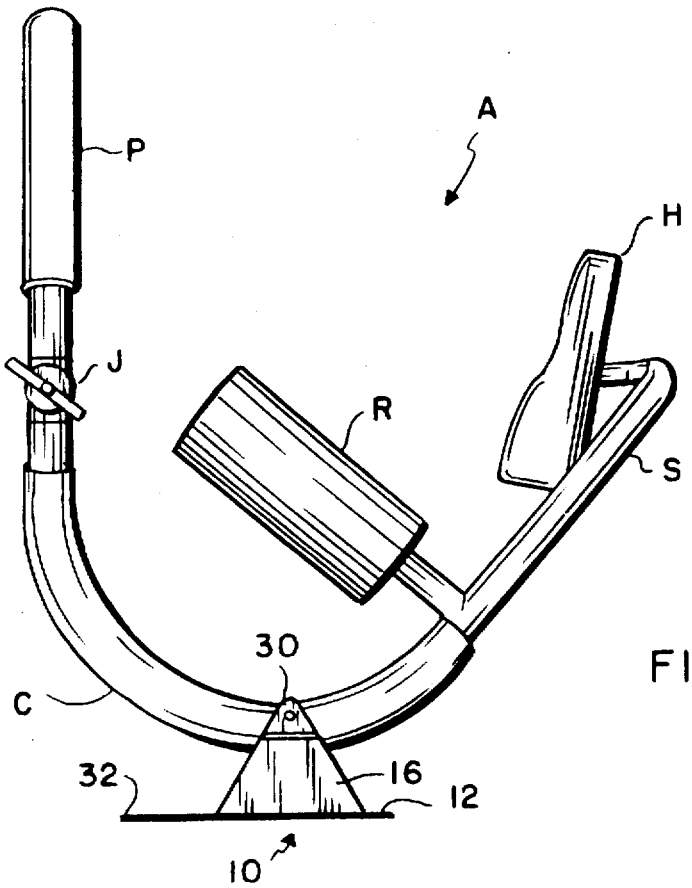
FIG. 4 is a left side view of the anchor plates and abdominal exercise device shown in FIG. 1.
Figure 5:
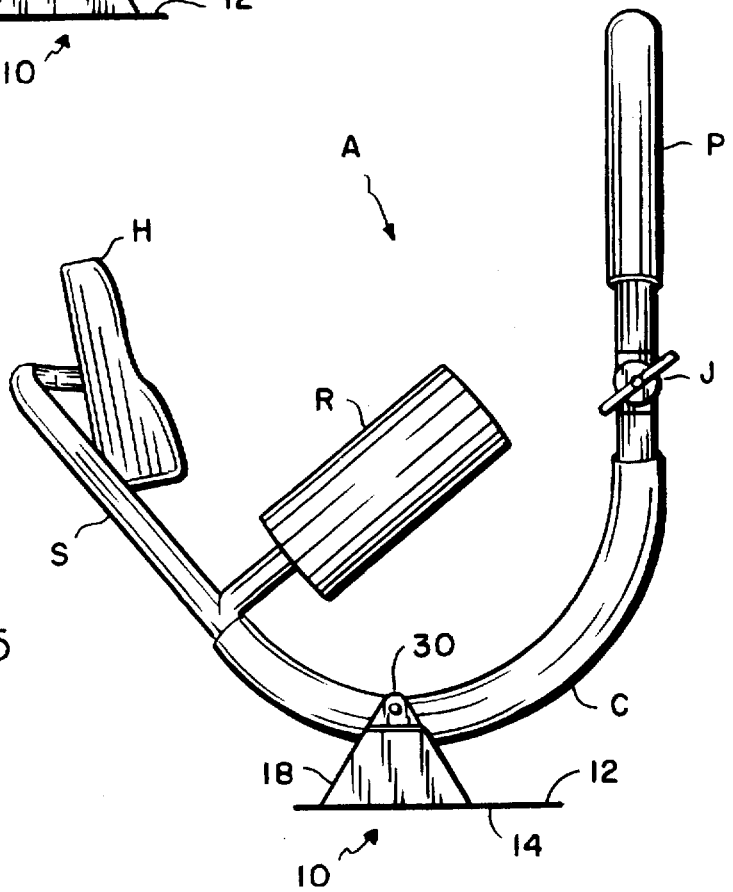
FIG. 5 is a right side view of the anchor plates and abdominal exercise device shown in FIG. 1.
Figure 6:
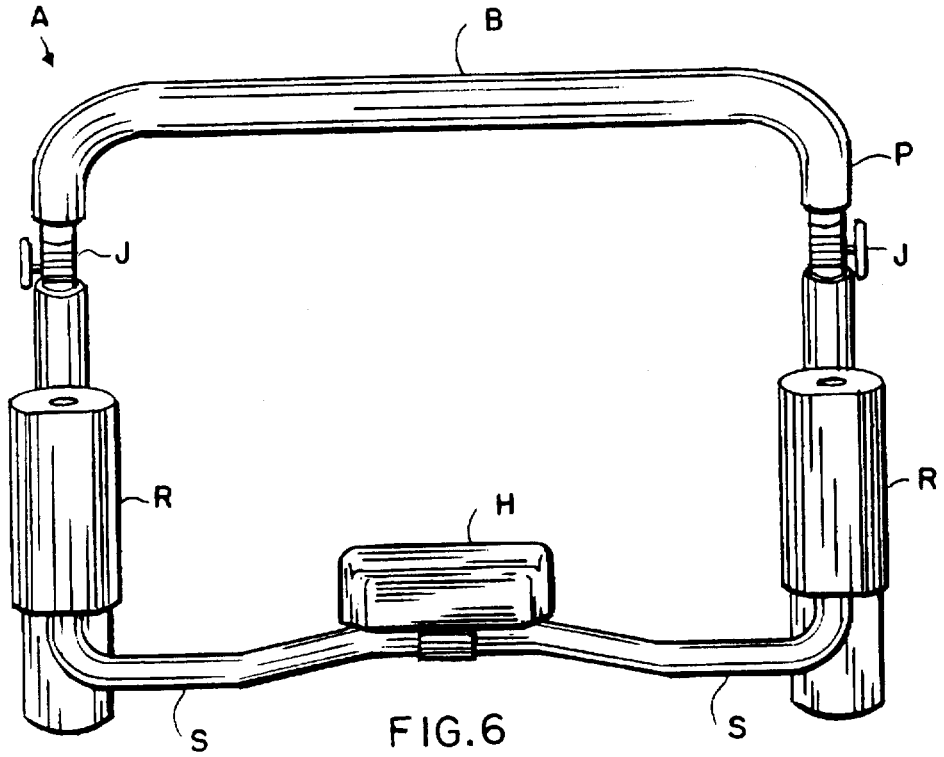
FIG. 6 is a top view of the anchor plates and abdominal exercise device shown in FIG. 1.
Figure 7:
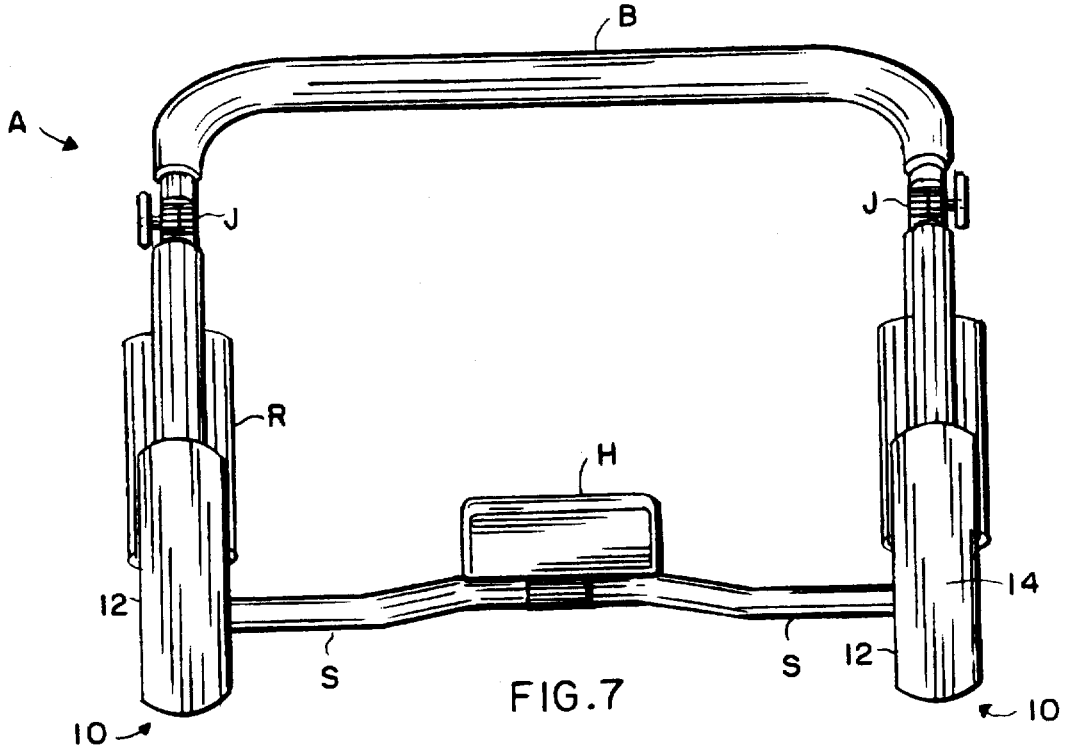
FIG. 7 is a bottom view of the anchor plates and abdominal exercise device shown in FIG. 1.

Referring to the drawings, particularly FIG. 1, the anchor plate 10 is shown acting in tandem with a second anchor plate to provide an abdominal exercise device A with a pair of stable and precise pivot points to define a precise pivot axis. The anchor plates 10 also provide some lift to the abdominal exercise device A as it moves or pivots forward.

As will be noted from even casual inspection of the drawings, the adjustable bar B (upon which a person's hands or arms may be placed) is forward of both the head rest H and the arm rests R. Prior to use, the section S intermediating the distance between the arm rests R and the head rest H generally lies flat upon the floor. At such time, the anchor plates 10 also rest flat upon the floor so that the entire assembly of both abdominal exercise device A and anchor plates 10 are ready for use by an individual seeking to develop stronger and firmer abdominal muscles.

The abdominal exercise device A generally encompasses the head and shoulders of an individual person. The person (not shown) rests his head upon the headrest H with his shoulders resting between the tubular sections S flanking the headrest H. The headrest H generally lies midway between the two opposite sections S. By resting his head upon the headrest H, the person is properly situated for use of the abdominal exercise device A.

Upon resting his head upon the headrest H, the person rests a portion of his arms upon the padded armrests R. Often, the portion of the arms that most comfortably upon the armrests R are adjacent and/or at the elbows, however, any portion of the arm comfortably coming to rest upon the armrests R is appropriate.

Such comfortable engagement of the armrests R by the arms is facilitated by manually engaging the bar B. The bar B is generally opposite the headrest H to place the armrests R between the bar B and the headrest H. With the placement of the hands comfortably upon the bar B, the arm portion most comfortably engaging the armrests R generally finds itself comfortably resting upon armrest R.

The curved portion C of the abdominal exercise device A responsible for the pivoting motion of the abdominal exercise device A begins its curvature adjacent the armrests R. The angle of curvature is shown in the drawings to be approximately forty degrees (40°). The radius of curvature may be in the approximate range of four to eight inches (4–8"). However, other angles and other radii of curvature may also be put to use to good advantage with a minimum of experimentation.

The curved portion C gives way to a straight portion P. The straight portion P travels away from the curved portion C to engage the bar B. Along with the parallel portions of the sections S, the curved portions C and the straight portions P are generally parallel to one another. The framework of bar B, straight portions P, curved portions C, and supporting sections S generally defines a closed and continuous path. This closed path enhances stability during use.

The headrest H, armrests R, and the bar B may all be padded, as may be the portions P. Curved portion C may be covered or coated with a resilient coating.

Intermediating the curved C and straight P portions may be an adjustably swivellable joint J, one joint for each side of the abdominal exercise device A. The adjustably swivellable joint J may be constructed of means known in the art, including a matched paired set of interlocking teeth set into place by a wingnut or the like threaded upon a bolt running through the set of interlocking teeth. A spring or other biasing means may be used to urge the two opposing and interlocking sets of teeth apart from one another when not held together by the wingnut. By providing adjustably swivellable joints J, the bar B and adjoining straight portions P can pivot upon the swivellable joints J, allowing the bar B to move close to or further away from the person using the abdominal exercise device A. Such movement of the bar B dramatically enhances the effectiveness of the abdominal exercise device A by allowing the person to engage in a wider variety of abdominal exercises of varying intensities and stresses.

The anchor plate 10 has a base pad 12 that is rectangularly oval in shape with straight sides and curved ends. The anchor plate 10 has flat upper and lower surfaces. The base pad 12 may be approximately eight inches (8") in length and approximately one and one half inches (1½") to one and three quarters inches (1¾") in width. The under surface of the anchor plate 10 may be coated with a non-skid material 14 which serves to increase the friction between the underlying floor F and the anchor plate 10. This prevents the anchor plate 10 from slipping and sliding, thereby enhancing the exercise experience for the user of the abdominal exercise A.

Flanking the base pad 12 towards the rear thereof are two brace supports 16. The brace supports 16 are generally perpendicular to the base pad 12. The brace supports 16 may be generally triangular in shape providing a wide lower portion 18 that engages the flanked sides of the base pad 12. The wide nature of the lower portion of brace supports 16 serves to distribute forces generated by the abdominal exercise device A so that pressure is distributed by the anchor plate 10 to the floor F.

Intermediating the wide lower portion 18 and narrower upper portion 20 of the brace support 16 is a intermediating portion 22 which serves to negotiate the smaller, approximately one and seven-sixteenths inches (1 7/16") width between the narrower upper portions 20 of the brace support 16 with the wider, approximately one and five-eighths inch (1⅝") distance between the wide lower portions 18 of the brace supports 16.

The intermediate portion 22 not only acts to negotiate the different widths between the upper and lower portions of the brace support 16, but also has a slight spring effect as it is able to slightly, but elastically, deform. This spring effect provides some shock absorption by the anchor plate 10 for the abdominal exercise device A.

The brace supports 16 have a narrower upper section 20 that serves to provide the precise pivot points about which the abdominal exercise device A rotates. The pair of anchor plates 10 with their corresponding of precise pivot points serve to define a pivot axis.

The brace support 16 defines small apertures 30 at the upper end of the narrower upper portions 20. These apertures 30 provide passage for bolts or the like in order to engage similar apertures found in the framework of the abdominal exercise device A. Bushings or other bearing surfaces or devices may be used to intermediate and reduce friction between the brace support 16 and the abdominal exercise device A. A bolt or the like passing through the brace support 16 and the adjacent section of the abdominal exercise device A may be used to secure the anchor plate 10 to the abdominal exercise device A. By threadingly engaging a nut upon the end of the bolt, the anchor plate 10 is secured to the abdominal exercise device A.

The wide lower portion 18 of the brace support 16 may be approximately four and one-half inches (4½") long with the pivot point aperture 30 laterally located approximately two and one-half inches (2½") from the rear edge of the wider lower portion 18. As the brace support 16 is located to the rear of the base pad 12, it is exceedingly difficult for the abdominal exercise device A to tip the anchor plate 10 forward. The same is similarly true for rearward travel of the abdominal exercise device A save that the rear projection of the base pad 12 need not be as long since there is more stability generally present for the rearward travel of the abdominal exercise device A.

In alternative embodiments of the present invention, side reinforcing ridges may extend from the wide lower portion 18 of the brace support 16 towards the front-most end 32 of the base pad 12. Such side reinforcing ridges serve to enhance the stability of the anchor plate 10 by stabilizing and reinforcing the brace supports 16. Additionally, a rear extension (not shown) may project rearwardly from the rear portion of the anchor plate 10 to enhance stability of the anchor plate 10.

In operation, once the anchor plate 10 has been attached to the abdominal exercise device A, it generally engages the floor as it normally would with its non-skid material 14 resting flat upon the underlying floor F. The section S between the head rest H and arm rest R also lies flat upon the floor F so that the abdominal exercise device A is stably situated and ready to receive a person desiring to exercise and firm their abdominal muscles.

When such a person has situated themselves comfortably within the framework of the abdominal exercise device A, the person generally has their hands or arms along bar B which, as shown in the Figures, is forward of the arm rests R and head rest H. The elbows or upper arms of the person generally rest upon the arm rests R and the head of the person is supported and cushioned by the head rest H.

The abdominal exercise device A serves to restrict the upper body activity that can be engaged by the person seeking to exercise their abdominal muscles. This forces almost all of the person's muscular activity into the abdominal muscles so that they must exercise and overcome the force of gravity as the person engages in a sit-up or sit-up-like action, raising their head from the floor F.

As the person's upper body is restricted and restrained by the abdominal exercise device A and as the head is supported by head rest H, the upper body muscles, including the muscles of the neck, are not required and are not available to lift the person up. Instead, the person's arms or hands resting on bar B serve to push the head and shoulders up as the person's abdominal muscles contract during the exercise maneuver.

By removing the person's upper body muscles from the exercise equation, all of the muscular activity must be undertaken by the abdominal muscles both in lifting the person off the floor F and gently replacing the person there. Muscular activity that had previously been undertaken by the upper body muscles, are now relocated to the abdominal muscles, enhancing the exercise session with respect to the abdominal muscles.

Normally, framework abdominal exercisers rock back and forth with the supporting structures of the framework following the movements of the person's anatomy. The contact points present at the upper body where the framework engages the person move with the person. As mentioned above, this rocking motion not only delivers a rotational motion, but also a forward and backward lateral motion that serves to distribute the muscular activity over a wider portion of the abdominal muscles than if a constant and stable axis of rotation (as defined between two precise pivot points) would provide. Additionally, as such framework exercise devices generally engage the floor F, the axis of rotation (as it travels forward and backward due to the rocking movement) lies along the floor F and below the spine of the person exercising. This serves to generate certain torques and forces which would be better removed by raising the abdominal exercise device as it moves forward from the floor F.

One of the significant advantages of the anchor plates 10 of the present invention is that they achieve both goals simultaneously. Not only do the anchor plates 10 of the present invention provide a stable and constant axis of rotation defined between two precise pivot points, but it also allows the abdominal exercise device A to lift up from the floor F as the person raises up off the floor F. By combining these two advantageous features into a single device, abdominal exercise may be greatly enhanced, delivering firmer abdominal muscles that not only provide greater back support, but also provide an attractive physical appearance.

While the present invention has been described with regards to particular embodiments, it is recognized that additional variations of the present invention may be devised without departing from the inventive concept.

What I claim is:

1. An abdominal exercise device with an anchor plate, comprising said abdominal exercise device including:

a headrest;

a pair of oppositely opposed armrests, said headrest coupled to said pair of oppositely opposed armrests by first and second supporting sections flanking said headrest, said first supporting section generally oppositely opposed said second supporting section, said headrest generally central to but offset from between said armrests;

first and second curved portions, said first curved portion generally oppositely opposed said second curved portion, said first and second curved portions respectively extending from said first and second supporting sections in a continuous manner;

first and second straight portions, said first straight portion generally oppositely opposed said second straight portion, said first and second straight portions respectively extending from said first and second curved portions in a continuous manner;

a bar, said bar coupling said first straight portion to said second straight portion, said bar extending from said first and second straight portions so that said first and second supporting sections, said first and second curved portions, said first and second straight portions and said bar cooperate to provide a continuous path; and said anchor plate including:

a base pad;

a first brace support attached to said base pad on a first side;

a second brace support attached to said base pad on a second side, said first and second brace supports forming a pair of brace supports;

said pair of brace supports flanking said base pad on opposing sides of said base pad and projecting upwardly therefrom, said pair of brace supports being sufficiently spaced apart to allow a portion of the abdominal exercise device to fit between said brace supports, said pair of brace supports supporting the abdominal exercise device above a floor, said brace supports pivotably connected to the abdominal exercise device; wherein each of said brace supports further comprise a wider lower portion attached to said base pad, said wider lower portion distributing forces from the abdominal exercise device to said base pad and a narrower upper portion coupled to said wider lower portion, said narrower upper portion defining an aperture through which a bolt may pass to pivotably connect the anchor plate to the abdominal exercise device, and wherein said aperture of said narrower upper portion is rearwardly offset from a longitudinal center of said base pad; whereby a precise pivot point about said pivotable connection between said brace supports and the abdominal exercise device may be provided to the abdominal exercise device by said anchor .plate, an axis of rotation defined by said precise pivot point raised above a floor and closer to abdominal muscles of a person using the abdominal exercise device.

2. The abdominal exercise device with an anchor plate of claim 1, further comprising:

an adjustable swivel joint interposed between said first curved portion and said first straight portion, said adjustable swivel joint allowing said first straight portion and said bar to pivot with respect to said first curved portion.

3. The abdominal exercise device with anchor plate of claim 2, further comprising:

said armrests extending generally perpendicular to said first and second supporting sections.

4. The abdominal exercise device with anchor plate of claim 3, wherein said headrest, said armrests, and said bar are all padded.

5. An abdominal exercise device with an anchor plate, comprising: said abdominal exercise device including a padded headrest;

a pair of oppositely opposed padded armrests, said padded headrest coupled to said pair of oppositely opposed padded armrests by first and second supporting sections flanking said padded headrest, said first supporting section generally oppositely opposed said second supporting section, said padded headrest generally central to but offset from between said padded armrests, said padded armrests extending generally perpendicular to said first and second supporting sections;

first and second curved portions, said first curved portion generally oppositely opposed and parallel to said second curved portion, said first and second curved portions respectively extending from said first and second supporting sections in a continuous manner;

first and second straight portions, said first straight portion generally oppositely opposed and parallel to said second straight portion, said first and second straight portions respectively extending from said first and second curved portions in a continuous manner;

a padded bar, said padded bar coupling said first straight portion to said second straight portion, said padded bar extending from said first and second straight portions so that said first and second supporting sections, said first and second curved portions, said first and second straight portions and said padded bar cooperate to provide a continuous path;

an adjustable swivel joint interposed between said first curved portion and said first straight portion, said adjustable swivel joint allowing said first straight portion and said bar to pivot with respect to said first curved portion; and said anchor plate including a base pad;

a first brace support attached to said base pad on a first side and a second brace support attached to said base pad on a second side, said first and second brace supports forming a pair of brace supports wherein each said brace supports, comprises:

a wider lower portion attached to said base pad, said wider lower portion distributing forces from the abdominal exercise device to said base pad; and a narrower upper portion coupled to said wider lower portion, said narrower upper portion defining an aperture through which a bolt may pass to pivotably connect the anchor plate to the abdominal exercise device, said aperture of said narrower upper portion rearwardly offset from a longitudinal center of said base pad;

a second brace support attached to said base pad on a second side, said first and second brace supports forming a pair of brace supports;

an inwardly-extending panel attached on an outer side to each said wider portion and on an inner side to each said narrower portion, said inwardly-extending panel performing as a shock-absorbing spring and elastically absorbing shocks and stresses transmitted by the abdominal exercise device to the anchor plate;

a non-skid surface, said non-skid surface attached to an underside of said base pad engaging a floor beneath said base pad, said non-skid surface allowing the anchor plate to resist slipping and sliding from shocks and stresses transmitted to the anchor plate from the abdominal exercise device;

a side reinforcing ridge, attached to each said wider lower portion of said brace supports and attached to said base pad, said side reinforcing ridges extending forwardly from said wider lower portion along said base pad;

said pair of brace supports flanking said base pad on opposing sides of said base pad and projecting upwardly therefrom, said pair of brace supports being sufficiently spaced apart to allow a portion of the abdominal exercise device to fit between said brace supports, said pair of brace supports supporting the abdominal exercise device above a floor, said brace supports pivotably connected to the abdominal exercise device; whereby a precise pivot point about said pivotable connection between said brace supports and the abdominal exercise device may be provided to the abdominal exercise device by said anchor plate, an axis of rotation defined by said precise pivot point raised above a floor and closer to abdominal muscles of a person using the abdominal exercise device.

* * * * *